United States Patent [19]

Röck et al.

[11] Patent Number: 4,700,994

[45] Date of Patent: Oct. 20, 1987

[54] DRAWER INCLUDING SIDE WALLS HAVING FRONT ENDS COVERED BY COVER MEMBERS

[75] Inventors: Erich Röck, Höchst; Helmut Hollenstein, Lustenau, both of Austria

[73] Assignee: Julius Blum Gesellschaft m.b.H., Höchst, Austria

[21] Appl. No.: 846,815

[22] Filed: Apr. 1, 1986

[30] Foreign Application Priority Data

Apr. 26, 1985 [AT] Austria ..... 1255/85

[51] Int. Cl.[4] ..... A47B 88/00

[52] U.S. Cl. ..... 312/330 R; 312/263; 403/231

[58] Field of Search ..... 312/263, 257 R, 330 R, 312/330.5 M, 311, 257 A, 257.5 M; 403/231, 403

[56] References Cited

U.S. PATENT DOCUMENTS

| | | | |
|---|---|---|---|
| 1,489,405 | 4/1924 | Wheary | 312/330 R |
| 1,936,733 | 11/1933 | Richardson | 312/330 R |
| 2,701,174 | 2/1955 | Franks | 312/263 |
| 3,375,051 | 3/1968 | Anderson | 312/330 R X |
| 3,729,246 | 4/1973 | Harrell et al. | 312/330 R |
| 4,108,520 | 8/1978 | Litchfield | 312/263 X |
| 4,128,284 | 12/1978 | King | 312/330 R |
| 4,303,289 | 12/1981 | Hardy | 312/330 R |
| 4,427,245 | 1/1984 | Litchfield et al. | 312/330 R |
| 4,466,675 | 8/1984 | Ferdinand et al. | 312/263 |
| 4,642,957 | 2/1987 | Edwards | 403/231 X |

FOREIGN PATENT DOCUMENTS

| | | | |
|---|---|---|---|
| A12030 | 6/1980 | European Pat. Off. | 312/330 R |
| 124059 | 11/1984 | European Pat. Off. | 312/330 R |
| 2202312 | 10/1973 | Fed. Rep. of Germany | 312/330 R |
| 316904 | 4/1934 | Italy | 312/311 |
| 1522598 | 8/1978 | United Kingdom | 312/330 R |
| A2129040 | 5/1984 | United Kingdom | 403/403 |

*Primary Examiner*—Kenneth J. Dorner
*Assistant Examiner*—Thomas A. Rendos
*Attorney, Agent, or Firm*—Wenderoth, Lind & Ponack

[57] ABSTRACT

A drawer is covered by a furniture door which is mounted on the side wall of a piece of furniture. The drawer has a front plate which is fastened to two drawer side walls. Caps which are pushed onto the front ends of the drawer side walls cover the side walls and parts of the front plate. The caps can have holding members for rail members.

7 Claims, 7 Drawing Figures

DRAWER INCLUDING SIDE WALLS HAVING FRONT ENDS COVERED BY COVER MEMBERS

FIELD AND BACKGROUND OF THE INVENTION

The invention relates to a drawer comprising a bottom plate, a rear wall, side walls in which running rails of a pull-out guide assembly are arranged, and a front plate fastened to the drawer side walls.

Drawers are generally provided with a front cover member which forms the front view of the piece of furniture. Such front cover members are usually of superior materials because they are substantially responsible for the esthetic impression of the piece of furniture.

Drawers have become known which are particularly used in the field of kitchen furniture and which are, in the fully inserted position, placed completely within the body of the piece of furniture, the body of the piece of furniture being provided with a door which covers the drawers.

Drawers of this kind have no front cover members but only front plates. The front plate differs from a front cover member usually by having a less intensive surface treatment and by having generally a simpler fastening to the drawer side walls, because the requirements with respect to the various possibilities of adjustment and positioning are not so great.

In particular in the case of double drawer side walls, for example drawer side walls of metal, extruded or injection moulded plastics material, there often exists the problem that the front ends of the drawer side walls are not covered by the front plate.

SUMMARY OF THE INVENTION

It is the object of the invention to provide an improved drawer of the above type.

According to the invention, this is achieved by the provision of caps arranged on both sides of the drawer and covering the front ends of the drawer side walls.

It is advantageously provided that the caps also cover a part of the front plate.

It is desired in some cases to provide the drawer with a rail member which forms a higher border than the drawer side wall, without making the drawer too bulky.

A preferred embodiment of the invention provides that each cap has holding means into which one rail member is insertable. Thus, the problem of fastening the rail member is solved with minimum expenditure.

An embodiment provides that each cap has at least one hook projecting into the drawer side wall and holding the cap to the drawer side wall, such hook advantageously engaging with a mounting angle member by means of which the front plate is fastened to the drawer side wall.

In this embodiment, each cap can be mounted by simply being pressed onto the drawer side walls.

To facilitate positioning of the cover cap, it is advantageously provided that the caps have one, preferably two, positioning members projecting into the drawer side walls.

BRIEF DESCRIPTION OF THE DRAWINGS

In the following two embodiments of the invention will be described in more detail with reference to the accompanying drawings in which.

DESCRIPTION OF THE PREFERRED EMBODIMENTS

Figure 1:
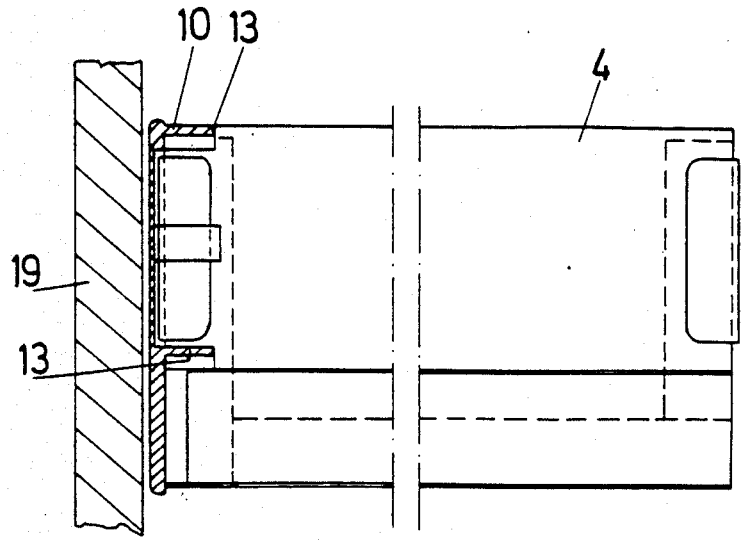
FIG. 1 is a side view of a drawer side wall, parts thereof being shown in section.

The drawer according to the invention comprises a bottom plate 1, a front plate 2, a rear wall 3 and two side walls 4.

In the illustrated embodiments, the drawer side walls 4 are double walls 5 made of metal.

One pull-out rail 6 is arranged in each of the drawer side walls 4.

The drawer side walls 4 have a fastening angle member 7 to which the front plate 2 is attached by means of screws 8.

Figure 2:
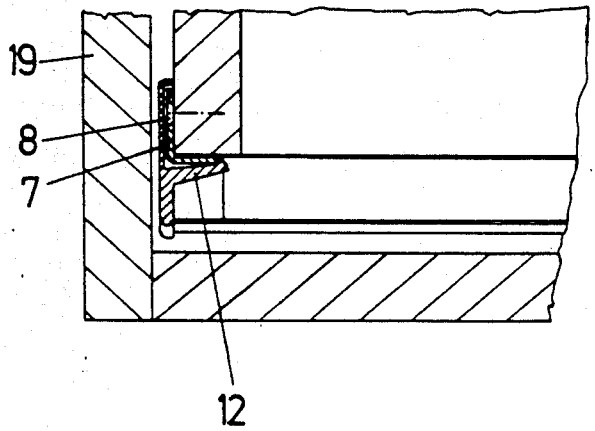
FIG. 2 is a plan view, partially in section, of a drawer in a region thereof of a corner formed between a front plate and a drawer side wall.
Figure 3:
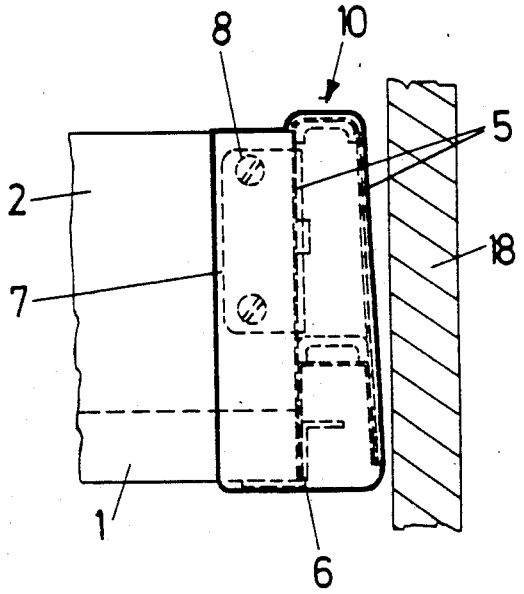
FIG. 3 is a front view of a drawer, one front corner only being illustrated.
Figure 4:
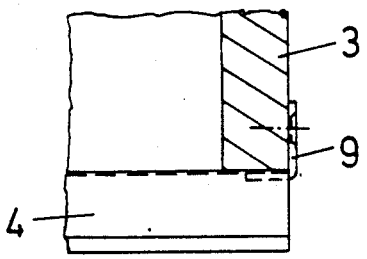
FIG. 4 is a top view of a rear corner connection.

Cover members or caps 10, 11 are mounted on the front ends of the drawer side walls 4. The caps 10 of the embodiment of FIGS. 1 to 3 have the same height as the drawer side walls 4 and fully cover the front ends of the drawer side walls 4 and a part of the front plate 2 so that the fastening angle member 7 is also covered by the cap 10.

For fastening, each cap 10 has a hook member 12 which projects into the drawer side wall 4 and engages with the fastening angle member 7, thus connecting cap 10 to side wall 4. The cap 10 can therefore simply be pushed onto the drawer side wall 4.

To facilitate positioning of the cap 10, the cap is provided with two positioning members 13 abutting on corresponding horizontal flanges of the drawer side wall 4.

Figure 5:
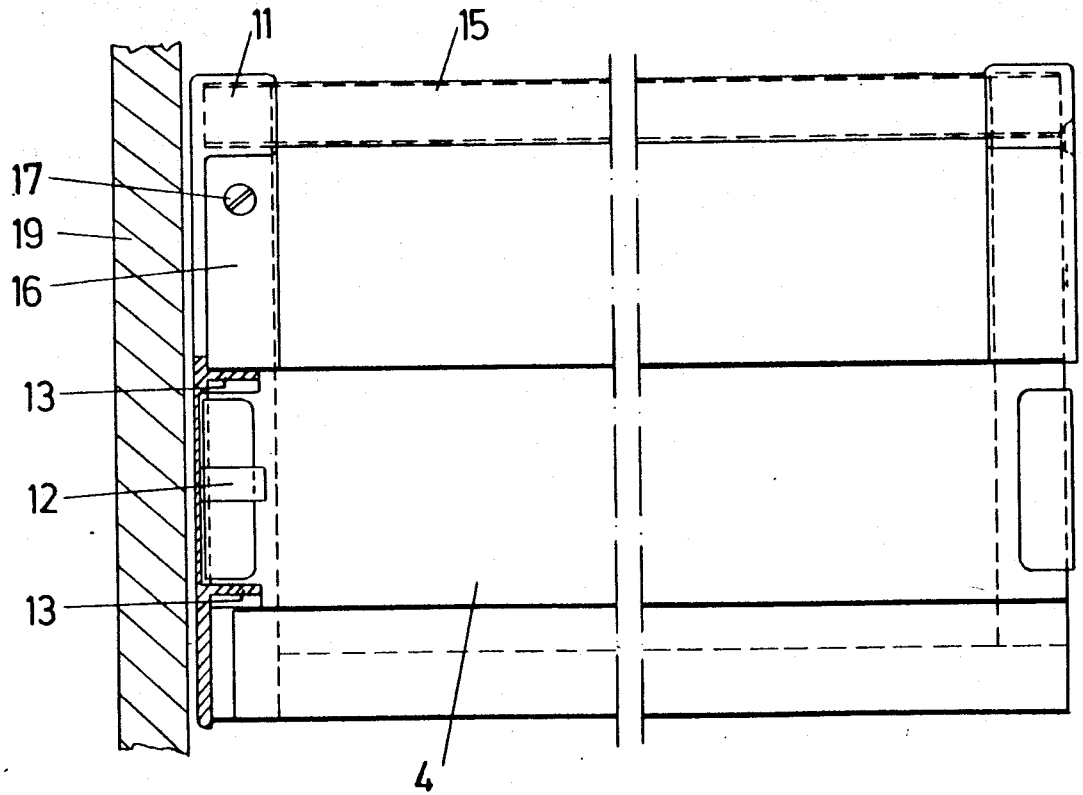
FIG. 5 is a side view of a drawer side wall of a further embodiment of the invention, parts thereof being shown in section.
Figure 6:
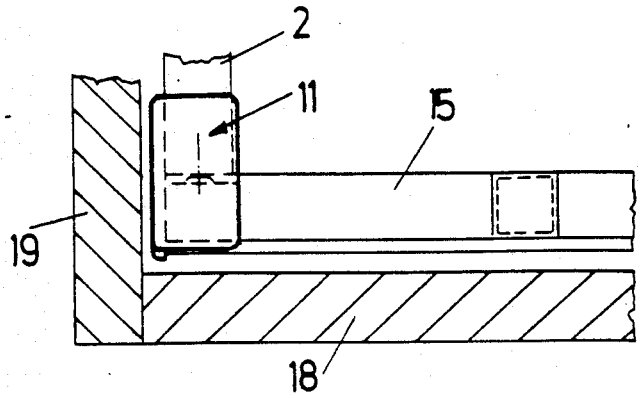
FIG. 6 is a top view of a corner connection between a front plate and a drawer side wall of this embodiment.
Figure 7:
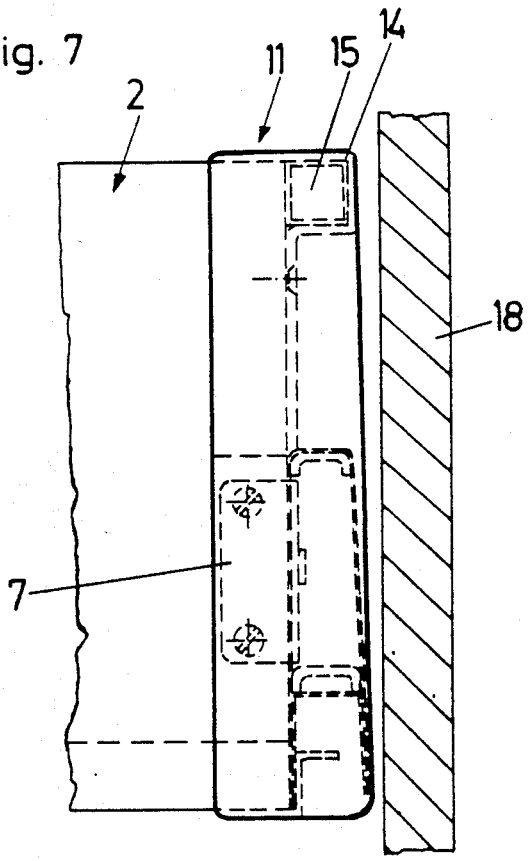
FIG. 7 is a front view of the drawer of this embodiment, again one front corner only being illustrated.

In the embodiment according to FIGS. 5 to 7, the cap 11 is higher than the drawer side wall 4. The front plate 2 has the same height as the cap 11. The cap 11 covers fully the drawer side wall 4 and a border region of the front plate 2. The drawer side wall 4 has a fastening angle member 7 which is attached to the front plate 2.

At the top the cap 11 has holding means 14 into which a rail member 15 is inserted. Rail member 15 has a square cross-section.

The cap 11 has a lateral flange 16 which covers a forward end portion of the front plate 2. A screw 17 by means of which the cap 11 is screwed to the front plate 2 projects through flange 16.

The cap 11 has, like the cap 10, a hook 12 which engages with the fastening angle member 7, and positioning members 13.

The drawings further show a side wall 18 of a piece of furniture and a furniture door 19 which forms the actual cover for all drawers of the piece of furniture.

What is claimed is:

1. A drawer comprising:

a bottom plate, a rear wall connected to said bottom plate, a pair of side walls connected to said rear wall and within which are to be arranged running rails of a pull-out guide assembly, and a front plate;

a pair of angle members, each said angle member connecting a respective end of said front plate to the front end of a respective said side wall, each said angle member including a first portion extending parallel to the respective said side wall and fastened thereto and a second portion extending parallel to said front plate and connected to the respective said end thereof; and a pair of cover members separate from said angle members, each said cover member being mounted directly on and covering said front end of a respective said side wall, each said cover member including a hook member extending into said respective side wall and engaging with said second portion of said respective angle member, thereby fastening said cover member to said side wall.

2. A drawer as claimed in claim 1, wherein said front plate is positioned between said side walls.

3. A drawer as claimed in claim 1, wherein each said cover member also covers said second portion of the respective said angle member.

4. A drawer as claimed in claim 1, wherein each said cover member also covers a portion of the front of said front plate.

5. A drawer as claimed in claim 1, wherein each said cover member includes at least one positioning member extending into said respective side wall and abutting a surface thereof, thereby positioning said cover member relative to said side wall.

6. A drawer as claimed in claim 1, wherein said front plate extends to a level higher than the top of said side walls, each said cover member includes a portion extending higher than said respective side wall and having a holding member, and further comprising rails positioned above respective said side walls, each said rail having a front end supported by a respective said holding member.

7. A drawer as claimed in claim 6, wherein said portion of each said cover member extending higher than the respective said side wall is fastened to the respective said end of said front plate.

* * * * *